US006854161B2

(12) United States Patent
Lee

(10) Patent No.: US 6,854,161 B2
(45) Date of Patent: Feb. 15, 2005

(54) APPARATUS FOR OPENING AND CLOSING DOOR

(75) Inventor: In-Gwang Lee, Namyangju-Si (KR)

(73) Assignee: Chan-In Jeong (KR)

( * ) Notice: Subject to any disclaimer, the term of this patent is extended or adjusted under 35 U.S.C. 154(b) by 0 days.

(21) Appl. No.: 10/341,213

(22) Filed: Jan. 13, 2003

(65) Prior Publication Data

US 2003/0177606 A1 Sep. 25, 2003

(30) Foreign Application Priority Data

Mar. 20, 2002 (KR) ..... 10-2002-0015180

(51) Int. Cl.[7] ..... E05F 3/20; E05F 1/14

(52) U.S. Cl. ..... 16/50; 76/54; 76/285; 76/68

(58) Field of Search ..... 16/50, 54, 280, 16/283, 284, 285, 303, 330, 55, 68, 72, 76

(56) References Cited

U.S. PATENT DOCUMENTS 1,226,258 A * 5/1917 Rogers ..... 16/54
2,434,524 A * 1/1948 Swanson ..... 16/54
2,485,937 A * 10/1949 Swanson ..... 16/54
2,490,258 A * 12/1949 Diebel ..... 16/54
4,068,344 A * 1/1978 Okabe ..... 16/54
4,358,870 A * 11/1982 Hong ..... 16/53
4,413,373 A * 11/1983 Sasaki ..... 16/54
4,485,522 A * 12/1984 Chen ..... 16/54
4,756,051 A * 7/1988 Shy ..... 16/50
4,829,628 A * 5/1989 Vuksic ..... 16/54
5,152,029 A * 10/1992 Pai ..... 16/54
5,572,768 A * 11/1996 Daul ..... 16/49
6,205,619 B1 * 3/2001 Jang ..... 16/352

FOREIGN PATENT DOCUMENTS

JP 2001032618 A * 2/2001 ..... E05F/1/12
WO WO 9954583 A2 * 10/1999

* cited by examiner

*Primary Examiner*—Chuck Y. Mah
(74) *Attorney, Agent, or Firm*—Cantor Colburn LLP

(57) ABSTRACT

An improved apparatus for opening and closing a door including a hydraulic hinge and a spring-type hinge is provided. The hydraulic hinge includes a rotary member having a first housing, a piston guide placed inside the first housing, a rotary shaft disposed inside the piston guide and a piston screwed with the rotary shaft, and a fixed member having a second housing, a cylinder placed inside the second housing and having an oil outlet penetrating the cylinder for allowing oil to pass through the oil outlet, an outflow part formed on the top surface of the cylinder and having a plurality of support protrusions, a head mounted on the top surface of the cylinder and an adjusting bolt screwed with the head such an oil circulating passage is formed in the fixed member. The spring-type hinge includes a spring for closing an opened door by compressive tension and an elevation part rotatably elevated while being rotated, the elevation part having a spring fixing part formed on the top surface thereof for fixing the lower end of the spring.

5 Claims, 4 Drawing Sheets

APPARATUS FOR OPENING AND CLOSING DOOR

TECHNICAL FIELD

The present invention relates to an apparatus for opening and closing a door in which a hydraulic hinge and a spring-type hinge form a pair of hinges and mounted on the upper portion and the lower portion of the door, respectively, such that the door can be automatically and slowly closed immediately after the door is opened. In particular, the present invention relates to an apparatus for opening and closing a door in which a hydraulic hinge and a spring-type hinge have a simple structure, the door with the hydraulic hinge can be smoothly operated without a clogging problem with foreign matters contained in oil, and the spring-type hinge can exhibit higher compressive tension.

BACKGROUND ART

In general, a door is installed in a building such that a user can come in and out through the door. The door is provided with an apparatus for opening and closing a door such that the door can rotate around a plurality of hinges mounted on the face of both the door and a doorframe.

There are various types of apparatuses for opening and closing a door. In recent days, there has been developed an apparatus for opening and closing a door in which a hydraulic hinge and a spring-type hinge form a couple of hinges for the purpose of promoting a user's safety and convenience in use. In the apparatus for opening and closing the door, the hydraulic hinge and the spring-type hinge are mounted between the upper end and the lower end of the door and the doorframe, respectively, so that an opened door can be automatically and slowly closed.

The hydraulic hinge and the spring-type hinge included in the apparatus for opening and closing the door are complex in structure and so difficult to manufacture and repair that it is almost impossible to repair them upon the occurrence of failure in the hinges.

Further, the hydraulic hinge is structured such that oil contained in a cylinder is circulated through a passage having a too small diameter when the door is opened and closed. As a result, the passage tends to be clogged up with foreign matters contained the oil and accordingly the function of the hydraulic hinge deteriorates. Thus, a user suffers from a trouble of frequently replacing the hydraulic hinge should by new one, thereby increasing economic burden.

Furthermore, in the hydraulic hinge of the conventional apparatus for opening and closing the door, a piston is coupled to a piston guide in such a manner that guide pieces formed on both sides of the piston are fitted into guide grooves formed on the piston guide. In consequence, a twisting force is generated in the guide pieces when the door is opened and closed, thereby causing the guide pieces to be incurably deformed and damaged.

Meantime, in the spring-type hinge of the conventional apparatus for opening and closing the door, both ends of a spring are directly fixed to a rotary member and a fixed member, respectively, such that there is generated only compressive tension in proportion to the radius of rotation of the door. Consequently, a force for opening and closing the door is inevitably weak, and an elastic force of the spring deteriorates when the spring-type hinge is used for a long period of time.

DISCLOSURE OF THE INVENTION

Accordingly, the present invention is directed to an apparatus for opening and closing a door that substantially obviates one or more problems due to limitations and disadvantages of the related art.

An object of the present invention is to provide an apparatus for opening and closing a door in which a hydraulic hinge and a spring-type hinge which form a couple of hinges to have a simple structure, making the hydraulic hinge smoothly operated without any clogging problem with oil upon the rotation of the door, and letting the spring-type hinge having higher compressive tension.

Another object of the present invention is to provide an apparatus for opening and closing a door capable of permitting a hydraulic hinge to have a higher binding force between a piston and a piston guide upon the rotation of the door.

Yet another object of the present invention is to provide an apparatus for opening and closing a door capable of finely adjusting the amount of oil outflow circulated in a hydraulic hinge upon the rotation of he door.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is proved to an improved apparatus for opening and closing a door, comprising a hydraulic hinge including a rotary member having a housing, a piston guide placed inside the housing, a rotary shaft disposed inside the piston guide and a piston screwed with the rotary shaft, the piston guide, the rotary shaft and the piston being structured for slowly closing the door, and a fixed member having a housing, a cylinder placed inside the housing and having an oil outlet formed therethrough for allowing oil to pass therethrough, a head mounted on the top surface of the cylinder and an adjusting bolt screwed with the head in such a manner as to form an oil circulating passage therein for adjusting the amount of oil outflow, and a spring-type hinge including a spring disposed therein for closing an opened door due to its compressive tension, which the improvement comprises: an outflow part formed on the top surface of the cylinder of the fixed member in the hydraulic hinge and having a plurality of support protrusions formed thereon for allowing the oil outlet to communicate with the oil circulating passage; and an elevation part disposed in the spring-type hinge to be rotatably elevated while being rotated and having a spring fixing part formed on the top surface thereof for fixing the lower end of the spring thereto whose upper end is fixed so as to have higher compressive tension of the spring.

The outer wall of the piston and the inner wall of the piston guide in the hydraulic hinge have corresponding polygonal shapes.

Further, the adjusting bolt is tapered down so that the lower end of the adjusting bolt and the oil outlet in the hydraulic hinge correspond to each other in shape.

In the meanwhile, the spring-type hinge includes a rotary member having a housing, an elevation guide placed inside the housing, a rotary shaft disposed inside the elevation guide and the elevation part screwed with the rotary shaft to be rotatably elevated and having the spring fixing-part formed on the top surface thereof for allowing the lower end of the spring to be fixed thereto, a fixed member having a housing, a tension adjusting bolt screwed with the housing and a spring coupling part protrudingly downwardly extending from the bottom surface of the tension adjusting bolt for allowing the upper end of the spring to be coupled thereto.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Figure 1:
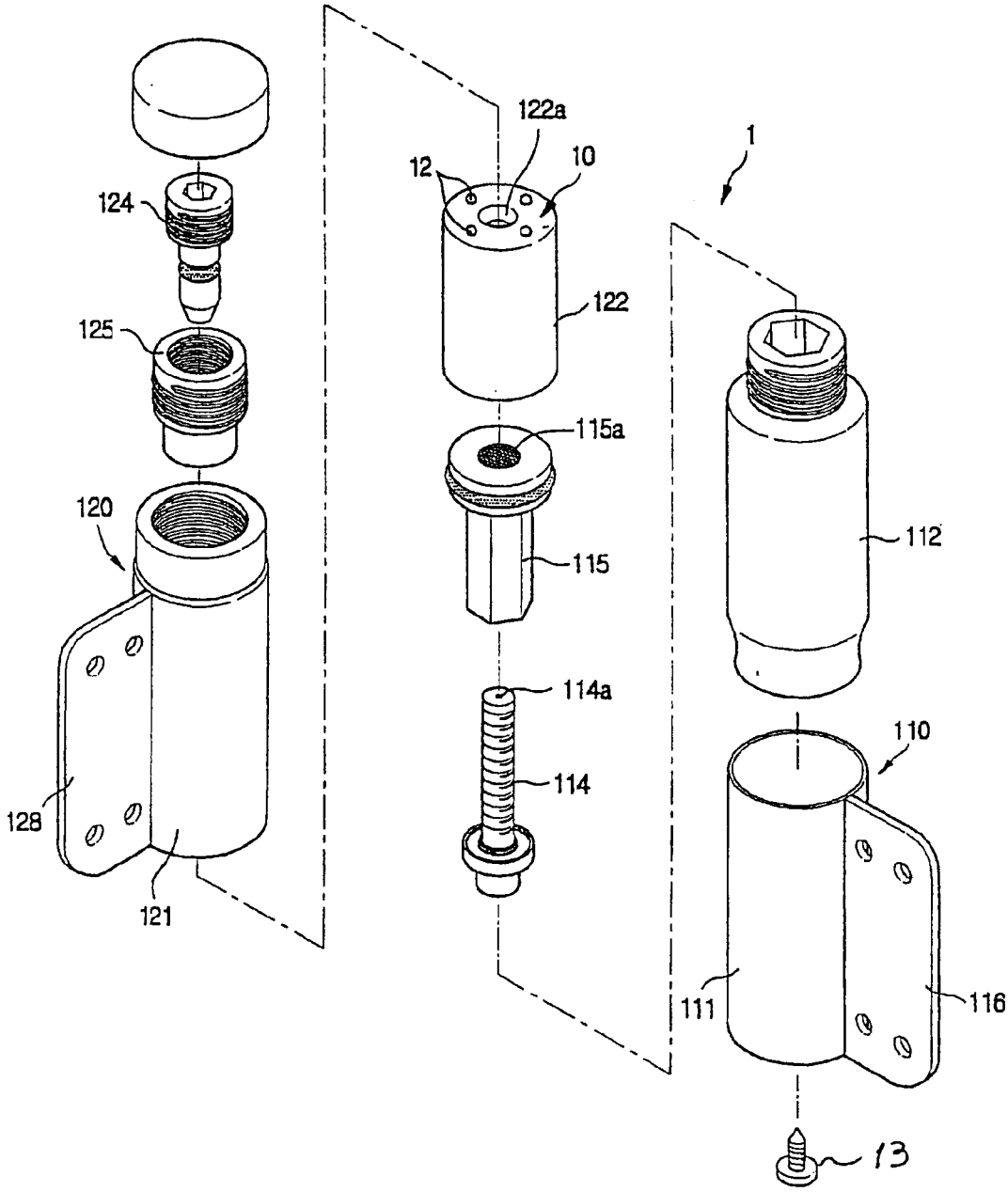
FIG. 1 is a schematic exploded view of a hydraulic hinge according to the present invention.
Figure 2:
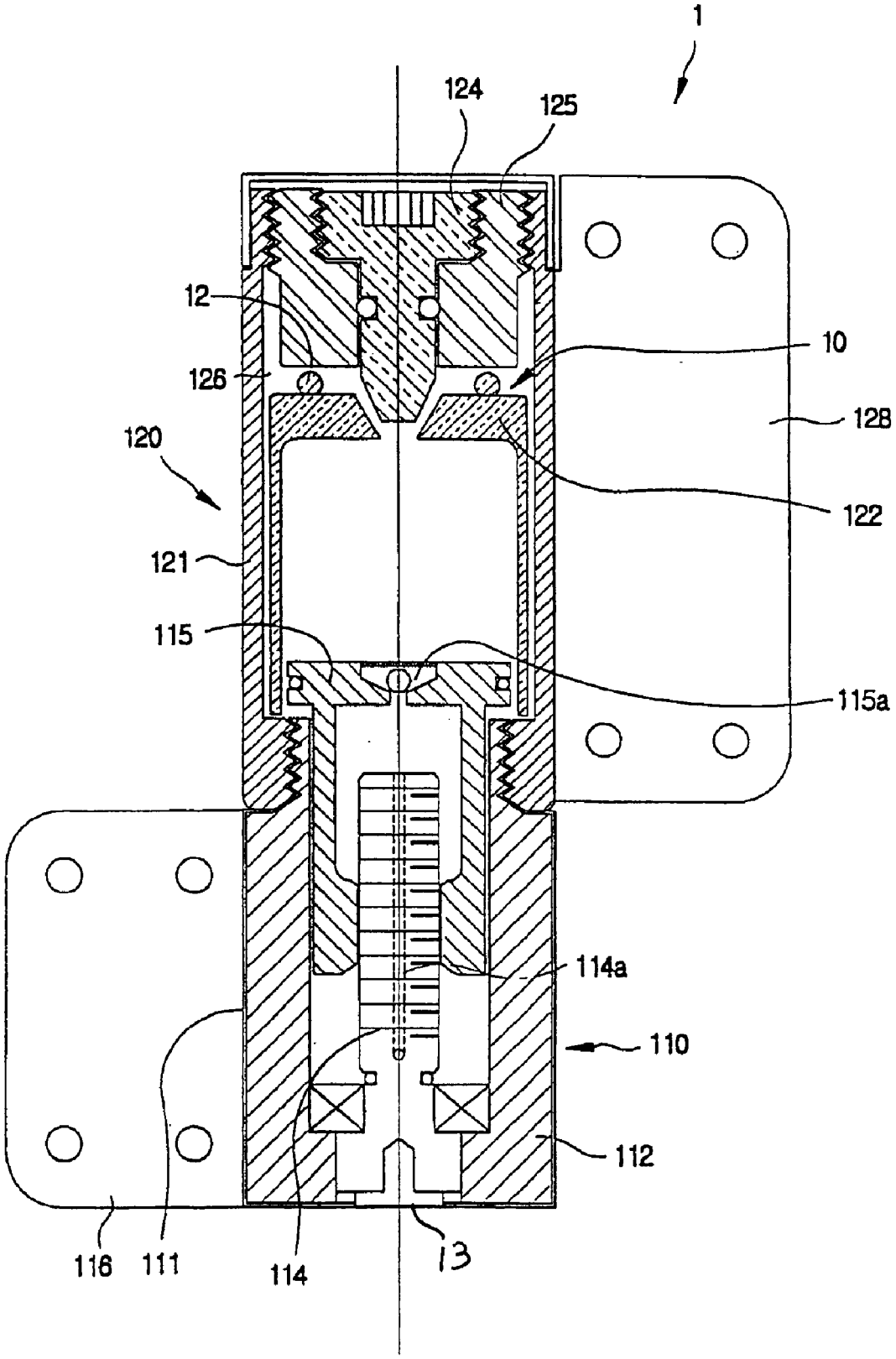
FIG. 2 is a cross-sectional view illustrating a state in which essential parts of the hydraulic hinge of FIG. 1 are assembled.

FIG. 1 is a schematic exploded view of a hydraulic hinge according to the present invention, and FIG. 2 is a cross-sectional view illustrating a state in which essential parts of, the hydraulic hinge of FIG. 1 are assembled.

An apparatus for opening and closing a door comprises a hydraulic hinge 1 and a spring-type hinge. The hydraulic hinge 1 includes a rotary member 110 having a cylindrical housing 111, a piston guide 112 placed inside the housing 111, a rotary shaft 114 placed inside the piston guide 112 and fixed to the housing 111 by means of, for example, a screw 13 and having an oil passage 114*a* formed therethrough, a piston 115 screwed with the rotary shaft 114 to be elevated and having an oil supply hole 115*a* formed therethrough and a door bracket 116 extending from the outer peripheral surface of the housing 111 and fixed to one side of the door, and a fixed member 120 having a cylindrical housing 121, a cylinder 122 placed inside the housing 121 and having an oil outlet 122*a* formed therethrough for allowing oil contained inside the cylinder 122 to pass therethrough upon the rotation of the door, a head 125 mounted on the top surface of the cylinder 122, an adjusting bolt 124 screwed with the head 125 in such a manner as to form an oil circulating passage 126 therein for adjusting the amount of oil outflow and a doorframe bracket 128 formed on the outer peripheral surface of the housing 121 and fixed to one side of a doorframe. The present invention includes an oil outflow part 10 formed on the top surface of the cylinder 122 and having a plurality of support protrusions 12 formed thereon at predetermined intervals for allowing the oil outlet 122*a* to communicate with the oil circulating passage 126.

Accordingly, the oil contained in the cylinder flows out through the oil outlet and then through the wide oil circulating passage formed between the support protrusions by virtue of the piston which rises due to the rotation of the rotary shaft when the door is opened and closed, so that the present invention can prevent the oil passage from being clogged up with foreign matters contained in the oil.

Further, it is preferable that the outer wall of the piston 115 and the inner wall of the piston guide 112 have corresponding polygonal shapes, such that the piston screwed with the rotary shaft has a higher binding force therebetween than that generated when a piston directly mounted on the piston guide is elevated. As a consequence, the present invention can prevent deformation and damage problems having occurred between guide pieces of a conventional piston and guide grooves of a conventional piston guide.

The adjusting bolt 124 is tapered down in such a manner that the lower end hereof corresponds to the oil outlet 122*a* in shape. As a result, a gap between the adjusting bolt and the oil outlet can be finely adjusted and the amount of oil outflow circulated in the hydraulic hinge can also be finely adjusted.

Therefore, a user can easily and conveniently adjust the operation of the hydraulic hinge and close the door at a wanted speed.

Figure 3:
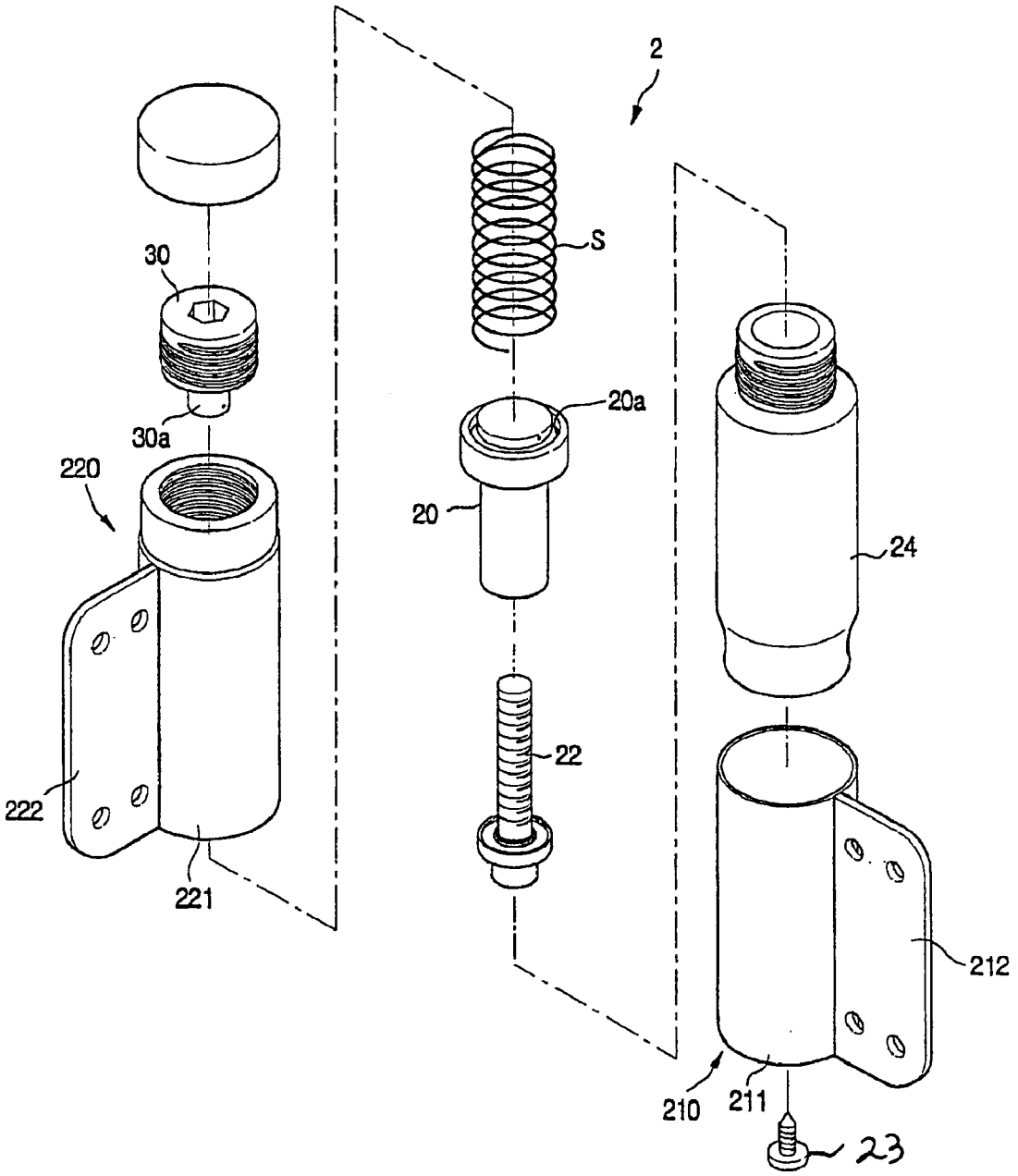
FIG. 3 is a schematic exploded view of a spring-type hinge according to the present invention.
Figure 4:
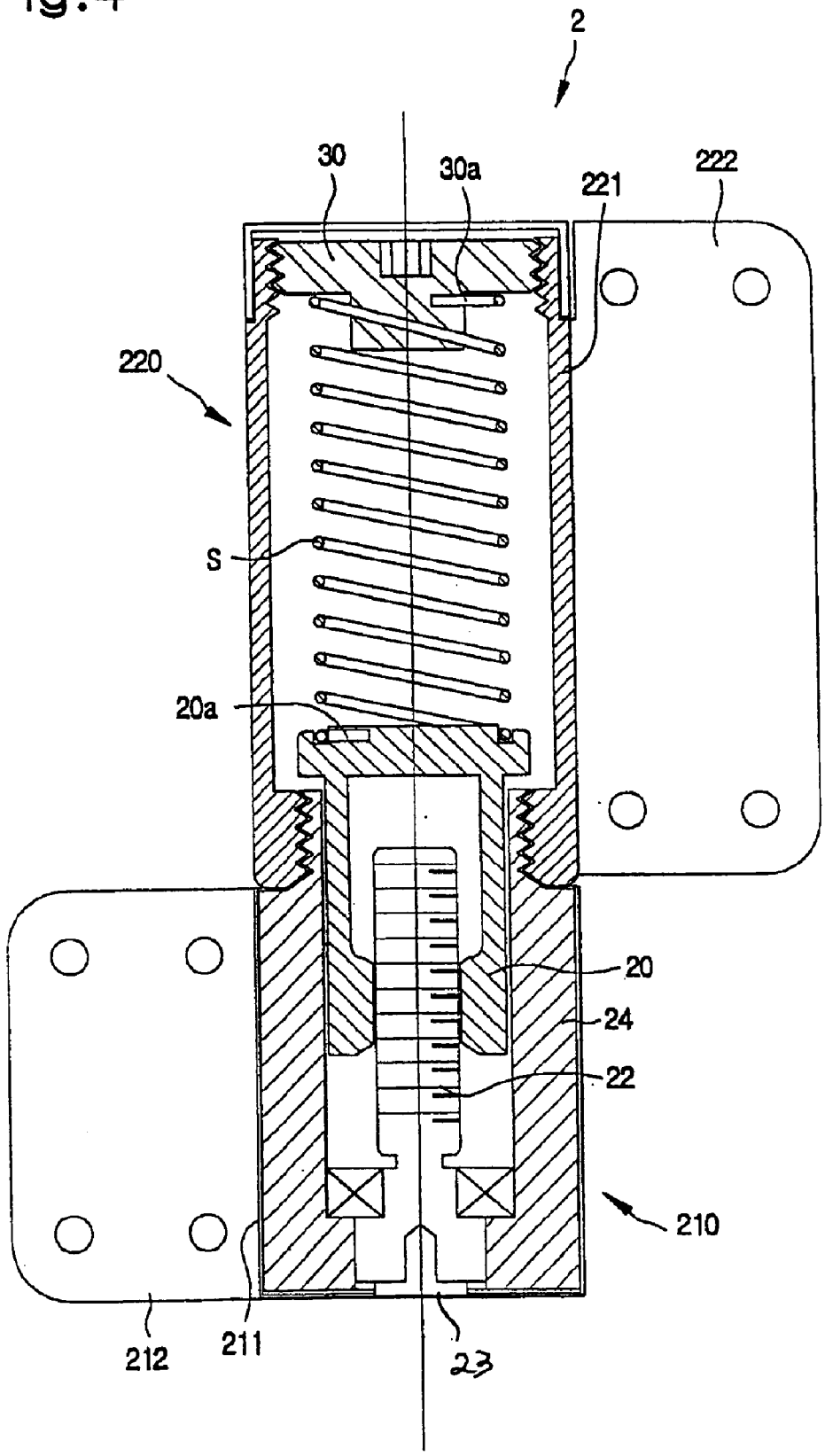
FIG. 4 is a cross-sectional view illustrating a state in which essential parts of the spring-type hinge of FIG. 3 are assembled.

FIG. 3 is a schematic exploded view of a spring-type hinge, and FIG. 4 is a cross-sectional view illustrating a state in which essential parts of the spring-type hinge of FIG. 3 are assembled.

As shown in FIGS. 3 and 4, a spring-type hinge 2 which forms a couple of hineges with a hydraulic hinge and is installed on the lower portion of the face of both a door and a doorframe includes a spring S disposed therein for closing an opened door due to its compressive tension. The present invention includes an elevation part 20 disposed in the spring-type hinge to be rotatably elevated while being rotated and having a spring fixing part 20*a* formed on the top surface thereof for allowing the lower end of the spring S to be fixed thereto whose upper end is fixed so as to have higher compressive tension of the spring.

According to the present invention, the spring-type hinge 2 includes a rotary member 210 having a housing 211, an elevation guide 24 placed inside the housing 211, a rotary shaft 22 disposed inside the elevation guide 24 and the elevation part 20 screwed with the rotary shaft 22 to be rotatably elevated and fixed to the housing 211 by means of, for example, a screw 23, and having the spring coupling part 20*a* formed on the top surface thereof for allowing the lower end of the spring S to be fixed thereto, and a fixed member 220 having a housing 221, which corresponds in shape to the housing 211, a tension adjusting bolt 30 screwed with the housing 221 and a spring coupling part 30*a* protrudingly downwardly extending from the bottom surface of the tension adjusting bolt 30 for allowing the upper end of the spring S to be coupled thereto.

Additionally, a door bracket 212 extends from the outer peripheral surface of the rotary member 210 and is fixed to one side of the door, and a doorframe bracket 222 extends from the outer peripheral surface of the fixed member 220 and fixed to one side of the doorframe.

The spring fixing part of the elevation part preferably has a groove formed thereon so that the lower end of the spring is fitted into the groove, and the spring coupling part of the tension adjusting part has a projection extending therefrom so that the upper end of the spring is coupled to the projection. It is preferable that a cap is mounted on the top surface of the housing of the fixed member.

The tension adjusting bolt 30 is screwed with the housing 221, and the lower end of the spring is fixed to the spring fixing part of the elevation part while the upper end of the spring is coupled to the spring coupling part of the tension adjusting bolt, such that compressive tension of the spring can be easily adjusted by rotating the tension adjusting bolt.

Accordingly, when the rotary member with the door bracket which is fixed to the door is rotated upon the rotation of the door, the rotary shaft and the elevation guide mounted inside the rotary member are rotated and thus the elevation part which is screwed with the rotary shaft and has the spring fixing part formed on the top surface thereof for allowing the lower end of the spring to be fixed thereto is elevated while being rotated.

Hence, there is generated compressive tension in the spring whose upper end is fixed to the spring coupling part of the tension adjusting bolt in the fixed member such that the spring is contracted, thereby opening the door.

Next, when compressive tension is generated again and the contracted spring is returned to its original position due to its force of restoration, the elevation part is rotated while falling down from the point of the upper end of the spring coupled to the spring coupling part of the tension adjusting bolt. Therefore, the rotary shaft screwed with the elevation part, the elevation guide and the rotary member are rotated, thereby closing the opened door.

Since the compressive tension of the spring becomes higher with the help of the elevation part which is rotatably elevated along the rotary shaft, the door can smoothly close.

As described above, the apparatus for opening and closing the door includes the simply structured hydraulic hinge and spring-type hinge, thereby achieving a simple manufacturing process and minimizing failure rate. Since the oil circulated in the cylinder disposed in the hydraulic hinge can be smoothly circulated upon the rotation of the door, the hydraulic hinge can be used without any failure for a long period of time. Since the compressive tension of the spring placed inside the spring-type hinge becomes higher due to the elevation part which is rotatably elevated along the rotary shaft, the door can be smoothly open and close.

In the hydraulic hinge of the apparatus for opening and closing the door, since the inner wall of the piston guide and the outer wall of the piston which is elevated in the piston guide have corresponding polygonal shapes, the binding force between the piston and the piston guide can be maximized and deformation and damage problems can be minimized.

Besides, since the amount of oil outflow circulated in the hydraulic hinge of the apparatus for opening and closing the door can be finely adjusted, the speed of the rotation of the door can be finely adjusted.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. An apparatus for opening and closing a door, comprising a hydraulic hinge including a rotary member and a fixed member;

wherein the rotary member includes:

a first housing adapted to fix to one side of a door;

a piston guide placed inside the first housing;

a rotary shaft disposed inside the piston guide and fixed to the first housing so that the rotary shaft rotates when the door is opened and closed; and a piston screwed with the rotary shaft to be rotatably elevated along the piston guide when the rotary shaft rotates;

wherein the fixed member includes:

a second housing adapted to fix to one side of a doorframe and screwed with the piston guide;

a cylinder placed inside the second housing and having an oil outlet penetrating the cylinder for allowing oil to pass through the oil outlet;

a head mounted on a top surface of the cylinder;

an adjusting bolt screwed with the head such that an oil circulating passage is formed in the fixed member for adjusting an amount of oil outflow; and an outflow part formed on the top surface of the cylinder and having a plurality of support protrusions formed on the outflow part for allowing the oil outlet to communicate with the oil circulating passage.

2. The apparatus according to claim 1, wherein an outer wall of the piston and an inner wall of the piston guide in the hydraulic hinge have corresponding polygonal shapes.

3. The apparatus according to claim 1, wherein the adjusting bolt in the hydraulic hinge is tapered down so that a lower end of the adjusting bolt corresponds to a shape of the oil outlet.

4. An apparatus for opening and closing a door, comprising a spring-type hinge including a rotary member and a fixed member;

wherein the rotary member includes:

a first housing adapted to fix to one side of a door;

an elevation guide placed inside the first housing; and a rotary shaft disposed inside the elevation guide and fixed to the first housing so that the rotary shaft rotates when the door is opened and closed;

an elevation part screwed with the rotary shaft to be rotatably elevated along the elevation guide when the rotary shaft rotates; and a spring fixing part formed on a top surface of the elevation part to be coupled with a lower end of a spring;

wherein the fixed member includes:

a second housing adapted to fix to one side of a doorframe and screwed with the elevation guide;

a tension adjusting bolt screwed with the second housing for adjusting the compressive tension of the spring; and a spring coupling part downwardly protruding and extending from a bottom surface of the tension adjusting bolt to be coupled with an upper end of the spring.

5. The apparatus according to claim 1, wherein the piston is configured to slowly close the door.

* * * * *